United States Patent [19]

Humen et al.

[11] Patent Number: 4,837,543

[45] Date of Patent: Jun. 6, 1989

[54] TRANSFORMER CORE AND COIL SUPPORT ASSEMBLY

[75] Inventors: Michael W. Humen; Augusto Hernandez, both of Waukesha, Wis.

[73] Assignee: Cooper Power Systems, Inc., Houston, Tex.

[21] Appl. No.: 251,103

[22] Filed: Sep. 28, 1988

[51] Int. Cl.[4] ..... H01F 27/02

[52] U.S. Cl. ..... 336/92; 336/196

[58] Field of Search ..... 336/67, 68, 92, 90, 336/197, 198, 210, 196

[56] References Cited

U.S. PATENT DOCUMENTS

| | | | |
|---|---|---|---|
| 2,248,606 | 7/1941 | Comilli | 336/210 X |
| 2,511,230 | 6/1950 | Wald | 175/359 |
| 3,270,305 | 8/1966 | Glassanos | 336/84 |
| 4,172,964 | 10/1979 | Reinebach | 178/46 |
| 4,631,509 | 12/1986 | Arii et al. | 336/92 |
| 4,673,907 | 6/1987 | Lee | 336/92 |

FOREIGN PATENT DOCUMENTS 439901 1/1936 United Kingdom .

*Primary Examiner*—Thomas J. Kozma

*Attorney, Agent, or Firm*—Michael, Best & Friedrich

[57] ABSTRACT

A transformer comprising a tank having side walls, a core including first and second generally vertical portions and upper and lower generally horizontal portions defining a core window, first and second coils respectively wound around the first and second vertical portions, and an I-beam which extends through the core window, which is supported by the side walls of the tank, and which includes an upper flange supporting the upper portion of the core, a lower flange supporting the coils, and a vertical web separating the coils.

28 Claims, 1 Drawing Sheet

TRANSFORMER CORE AND COIL SUPPORT ASSEMBLY

BACKGROUND OF THE INVENTION

The invention relates to supporting structure for the core and coil assembly of a transformer.

Known support structures in use today rest on the bottom of the transformer tank. As a result, the bottom plate of the transformer tank supports the weight of the core and coil assembly.

Attention is directed to the following U.S. Pat. Nos.:

| | | |
|---|---|---|
| Arli et al. | 4,631,509 | Dec. 23, 1986 |
| Lee | 4,673,907 | Jun. 16, 1987 |
| Reinebach | 4,172,964 | Oct. 30, 1979 |
| Glassanos | 3,270,305 | Aug. 30, 1966 |
| Wald | 2,511,230 | June 13, 1950 |

Attention is also directed to British Pat. No. 439,901.

SUMMARY OF THE INVENTION

The invention provides a transformer comprising a tank and a core and coil assembly. The core and coil assembly includes a core having spaced-apart vertical portions and spaced-apart horizontal portions extending between the vertical portions. The core portions define a core window. The core and coil assembly also includes a coil wound around each of the vertical portions of the core.

The transformer also comprises a support member or beam which extends through the core window, which supports the core and coil assembly and which is supported by the side walls of the tank. More particularly, the support member or beam has an I-shaped cross section and includes a horizontal upper flange, a horizontal lower flange, and a vertical web extending between the flanges. The opposite ends of the support member are supported by brackets fixed to the side walls of the tank.

The upper portion of the core is supported by the upper flange. In other words, the upper portion of the core rests on top of the upper flange of the beam. As a result, the vertical portions of the core hang from the upper Portion and are therefore in tension, unlike in known prior art constructions. Placing the vertical portions of the core in tension reduces the increased losses that result when the vertical portions are in compression.

The coils are supported by the lower flange of the beam. The height of the coils is approximately equal to the height of the web Portion of the support member, and the inner portions of the coils, i.e., the portions within the core window, extend between the upper and lower flanges of the support member. The support member is made from an insulating material and acts as an insulator between the coils and also from coil to core ground. The support member also anchors and supports connecting leads extending from the coils.

Other features and advantages of the invention will become apparent to those skilled in the art upon review of the following detailed description, claims and drawings.

Figure 3:
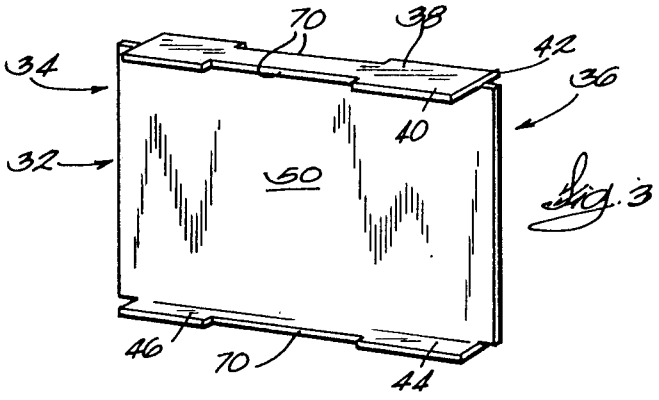
FIG. 3 is a perspective view of the support member.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the Phraseology and terminology used herein is for the Purpose of description and should not be regarded as limiting.

DESCRIPTION OF THE PREFERRED EMBODIMENT

A transformer 10 embodying the invention is illustrated in the drawings.

Figure 2:
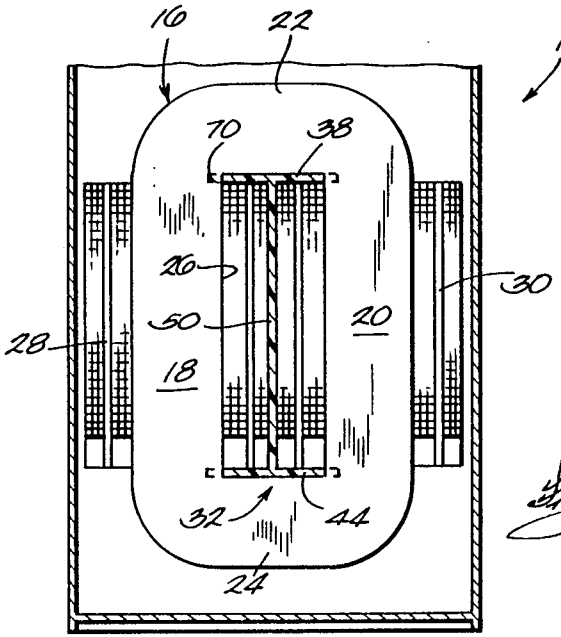
FIG. 2 is a partial vertical cross sectional view of the transformer.

The transformer 10 comprises a tank 12 having a bottom 13 and a side wall or walls 14. The transformer 10 also comprises a core 16 including (see FIG. 2) first and second or left and right spaced-apart, generally vertical portions 18 and 20 and upper and lower spaced-apart, generally horizontal portions 22 and 24 extending between the vertical portions. The vertical and horizontal portions 18, 20, 22 and 24 define a core window 26. The transformer 10 also comprises first and second or left and right coils 28 and 30 respectively wound around the left and right vertical portions 18 and 20 of the core 16. The transformer 10 as thus far described is conventional.

Figure 4:
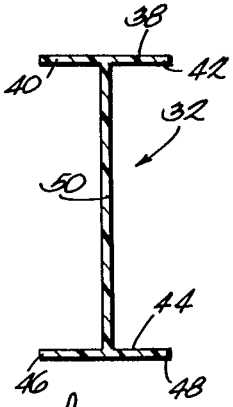
FIG. 4 is a vertical cross sectional view of the support member.

The transformer 10 also comprises an elongated support member or I-beam 32. The I-beam 32 is made of a strong insulating material and includes left and right (as shown in FIG. 3) ends 34 and 36, a horizontal upper flange 38 including first and second or left and right (as shown in FIG. 4) flange portions 40 and 42, a horizontal lower flange 44 including first and second or left and right (as shown in FIG. 4) flange portions 46 and 48, and a vertical web 50 extending between and connecting the flanges 38 and 44.

Figure 1:
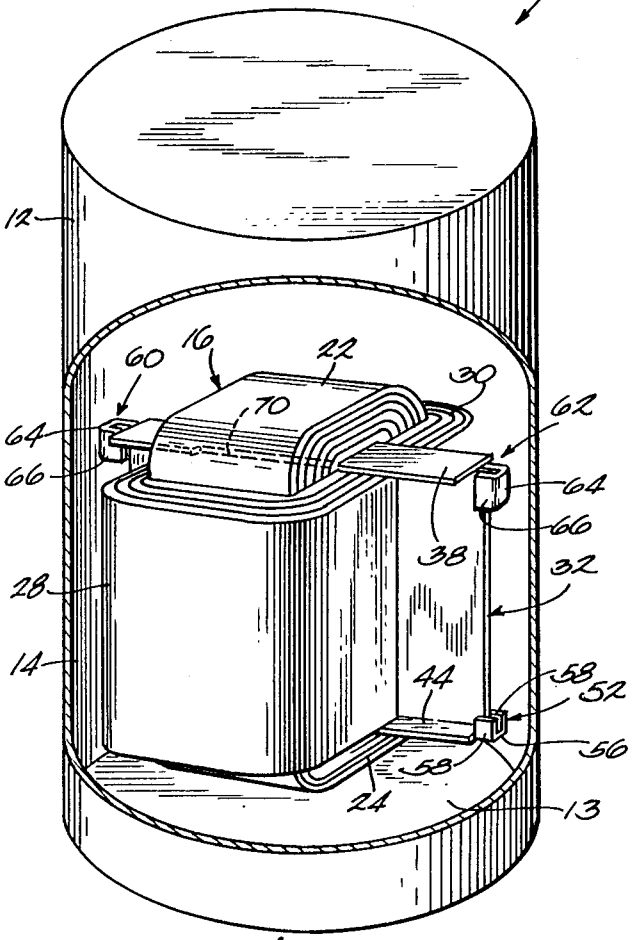
FIG. 1 is a perspective view, partially cut away, of a transformer embodying the invention and comprising a coil and core assembly and a support member therefor.

The I-beam 32 is supported above the bottom 13 of the tank 12 by the side walls 14 of the tank 12. More particularly, the side walls 14 of the tank 12 have thereon (see FIG. 1) diametrically opposed, lower brackets 52 (only the right bracket 52 is shown) supporting the opposite ends 34 and 36 of the I-beam 32. Each lower bracket 52 has a U-shaped vertical cross section and includes a horizontal base 56 and spaced, vertical portions 58. In the Preferred embodiment, the web 50 of the I-beam 32 extends beyond the flanges 38 and 44 at both ends of the I-beam 32 (this is best shown in FIG. 3), and each end of the web 50 rests on the base 56 of a bracket 52 between the vertical Portions 58 thereof (as shown in FIG. 1). The side walls 14 of the tank 12 also have thereon (see FIG. 1) diametrically opposed, upper brackets 60 and 62 laterally supporting the left and right ends, respectively, of the I-beam 32. More particularly, each bracket 60 or 62 has a U-shaped horizontal cross section and includes a base 64 and spaced, horizontal portions 66 extending on opposite sides of the web 50 of the I-beam 32. The upper brackets 60 and 62 prevent horizontal movement of the I-beam 32 but do not support the weight of the I-beam 32.

The I-beam 32 extends through the core window 26 and supports the core 16 and the coils 28 and 30 above the bottom 13 of the tank 12. In other words, the I-beam 32 supports the weigh of the core 16 and the coils 28 and 30. More particularly, the core 16 is wound around the I-beam 32 and the upper portion 22 of the core 16 rests on the upper flange 38 of the I-beam 32. The left and right coils 28 and 30 rest on the left and right portions, respectively, of the lower flange 44. Thus, the I-beam 32 supports the coils 28 and 30 independently of the core 16. Alternatively stated, the weight of the coils 28 and 30 is transferred directly to the lower flange 44 of the I-beam 32 and is not transferred to the I-beam 32 through the core 16. The portions of the coils 28 and 30 within the core window 26 extend between the upper and lower flanges 38 and 44 and the web 50 separates the coils 28 and 30.

The I-beam 32 also includes means for fixing the position of the core 16 (and therefore the coils 28 and 30) axially of the 1-beam 32. While various suitable means can be employed, in the preferred embodiment, such means includes notches or recesses 70 in the flange portions 40, 42, 46 and 48 of the I-beam 32. As shown in the drawings, the core 16 extends into the notches 70 so that the opposite ends of the notches 70 prevent movement of the core 16 axially of the I-beam 32.

The I-beam 32 transfers the weight of the core 16 and coils 28 and 30 to the side walls 14 of the tank 12 and keeps the weight of the core 16 and coils 28 and 30 off the bottom 13 of the tank 12. Also, the I-beam 32 acts as an insulator between the coils 28 and 30 and also from coil to core ground. Furthermore, the I-beam 32 can anchor and support connecting leads (not shown) extending from the coils 28 and 30.

Various feature of the invention are set forth in the following claims.

We claim:

1. A transformer comprising
a tank having side walls,
a core defining a core window, and
an I-beam which extends through said core window, which supports said core and which is supported by said side walls of said tank.

2. A transformer as set forth in claim 1 wherein said core includes first and second spaced-apart, generally vertical portions partially defining said core window, wherein said transformer further comprises first and second coils respectively wound around said first and second vertical portions, and wherein said I-beam is made of insulating material and separates said coils.

3. A transformer as set forth in claim 2 wherein said I-beam includes first and second generally horizontal flange portions respectively supporting said first and second coils.

4. A transformer as set forth in claim 1 wherein said core includes a generally horizontal upper portion resting on said I-beam.

5. A transformer as set forth in claim 4 wherein said I-beam includes an upper flange, and wherein said upper portion of said core rests on said upper flange.

6. A transformer as set forth in claim 1 wherein said I-beam includes upper and lower flanges, and wherein each of said coils extends between said upper and lower flanges.

7. A transformer as set forth in claim 1 wherein said I-beam includes means for fixing the position of said core axially of said I-beam.

8. A transformer as set forth in claim 7 wherein said means for fixing the position of said core includes a notch in said I-beam, and wherein said core extends into said notch.

9. A transformer comprising
a tank,
a core defining a core window and including first and second spaced-apart, generally vertical portions partially defining said core window,
first and second coils respectively wound around said first and second vertical portions, and
a member which extends through said core window, which supports said coils independently of said core and which is supported by said tank.

10. A transformer as set forth in claim 9 wherein said member is an I-beam.

11. A transformer as set forth in claim 9 wherein said member is made of insulating material and separates said coils.

12. A transformer as set forth in claim 9 wherein said member includes first and second generally horizontal flange portions respectively supporting said first and second coils.

13. A transformer as set forth in claim 9 wherein said member also supports said core.

14. A transformer as set forth in claim 13 wherein said core includes a generally horizontal upper portion resting on said member.

15. A transformer as set forth in claim 14 wherein said member is an I-beam including an upper flange, and wherein said upper portion of said core rests on said upper flange.

16. A transformer as set forth in claim 9 wherein said member is an I-beam including upper and lower flanges, and wherein each of said coils extends between said upper and lower flanges.

17. A transformer as set forth in claim 9 wherein said member includes means for fixing the position of said core axially of said member.

18. A transformer as set forth in claim 17 wherein said means for fixing the position of said core includes a notch in said member, and wherein said core extends into said notch.

19. A transformer comprising
a tank,
a core defining a core window and including first and second spaced-apart, generally vertical portions Partially defining said core window,
first and second coils respectively wound around said first and second vertical portions, and
an I-beam which extends through said core window, which supports said core and said coils and which is supported by said tank.

20. A transformer as set forth in claim 19 wherein said I-beam is made of insulating material and separates said coils.

21. A transformer as set forth in claim 19 wherein said I-beam includes first and second generally horizontal flange portions respectively supporting said first and second coils.

22. A transformer as set forth in claim 19 wherein said core includes a generally horizontal upper portion resting on said I-beam.

23. A transformer as set forth in claim 22 wherein said I-beam includes an upper flange, and wherein said upper Portion of said core rests on said upper flange.

24. A transformer as set forth in claim 23 wherein said I-beam also includes a lower flange having first and second flange portions respectively supporting said first and second coils.

25. A transformer as set forth in claim 24 wherein each of said coils extends between said upper and lower flanges.

26. A transformer as set forth in claim 25 wherein said tank has side walls, and wherein said I-beam is supported by said side walls.

27. A transformer as set forth in claim 19 wherein said I-beam includes means for fixing the position of said core axially of said I-beam.

28. A transformer as set forth in claim 27 wherein said means for fixing the position of said core includes a notch in said I-beam, and wherein said core extends into said notch.

* * * * *